US005489045A

United States Patent [19]

Jennings

[11] Patent Number: 5,489,045

[45] Date of Patent: Feb. 6, 1996

[54] DOOR ALARM/SPRAYER WITH OPTIONS

[76] Inventor: Roy H. Jennings, P.O. Box 81481, Corpus Christi, Tex. 78468

[21] Appl. No.: 18,729

[22] Filed: Feb. 17, 1993

[51] Int. Cl.[6] ..... B65D 3/14; G08B 13/08

[52] U.S. Cl. ..... 222/39; 116/77; 116/86; 116/DIG. 44; 222/180; 239/274; 239/289

[58] Field of Search ..... 222/3, 5, 39, 180, 222/402.14, 402.15; 239/274, 289; 116/77, 82, 86, 100, DIG. 44; 340/548, 549, 691; 109/1 R, 25, 31, 38

[56] References Cited

U.S. PATENT DOCUMENTS

| | | | |
|---|---|---|---|
| 3,653,342 | 4/1972 | Chilton | 109/31 |
| 3,806,000 | 4/1974 | Fegley | 222/402.14 X |
| 3,899,105 | 8/1975 | Fegley et al. | 222/5 |
| 3,963,145 | 6/1976 | Fegley et al. | 222/5 |
| 3,967,757 | 7/1976 | Fegley | 222/5 |
| 3,972,447 | 8/1976 | Fegley | 222/5 |
| 4,018,361 | 4/1977 | Fegley | 222/5 |
| 4,024,986 | 5/1977 | Fegley et al. | 222/5 |
| 4,055,277 | 10/1977 | Fegley et al. | 222/5 |
| 4,062,473 | 12/1977 | Fegley | 222/5 |
| 4,068,780 | 1/1978 | Fegley | 222/5 |
| 4,090,644 | 5/1978 | Fegley | 222/402.14 X |
| 4,118,691 | 10/1978 | Sims | 222/3 |
| 4,202,471 | 5/1980 | Fegley | 222/402.14 X |
| 4,275,820 | 6/1981 | LeBlond | 222/3 |
| 4,394,934 | 7/1983 | Fegley | 222/5 |
| 4,454,963 | 6/1984 | Fegley | 222/5 |
| 5,034,730 | 7/1991 | Lin | 222/3 X |
| 5,182,541 | 1/1993 | Bajorek et al. | 222/3 X |

FOREIGN PATENT DOCUMENTS

| | | | |
|---|---|---|---|
| 2557336 | 6/1985 | France | 340/549 |

*Primary Examiner*—Andres Kashnikow
*Attorney, Agent, or Firm*—Daniel Vera

[57] ABSTRACT

A portable anti-burglar device with optional fluid dispensing, alarm and fingerprint retention features is disclosed which when activated by the opening of a door or window or other violation of a secured aperture a spring biased actuating member operates to discharge a pre-packaged tear gas or identification fluid or other liquid dispersing canister and simultaneously close an electrical switch which is in series with another switch which controls the optional operation of an audible alarm when the device is activated regardless of whether a pressurized canister is in place. The device is portable and is coated with a wax or tar which can preserve fingerprints that may be deposited on the device by an intruder's attempt to deactivate it. The device is fitted with moveable mounting brackets which allow for a variety of mounting situations and also with a tamper resistant locking mechanism.

6 Claims, 8 Drawing Sheets

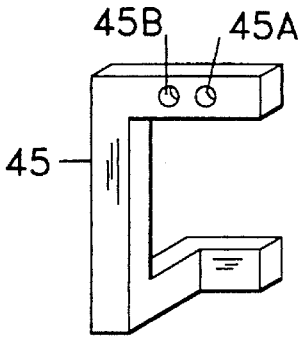
FIG. 9-A
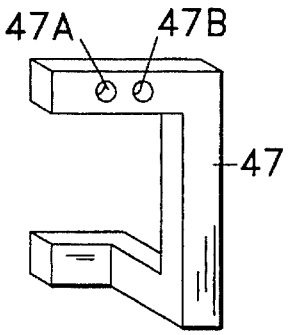
FIG. 9-B
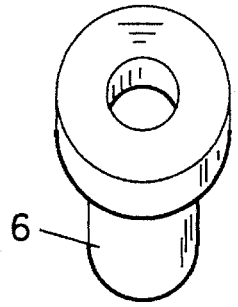
FIG. 10
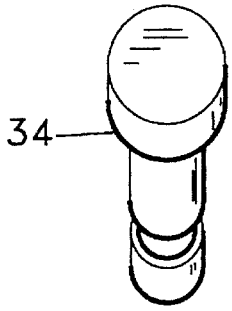
FIG. 11
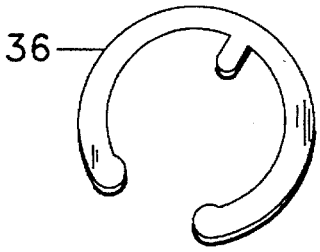
FIG. 12
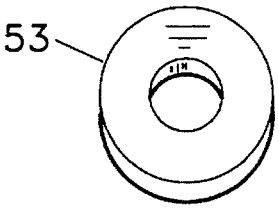
FIG. 13
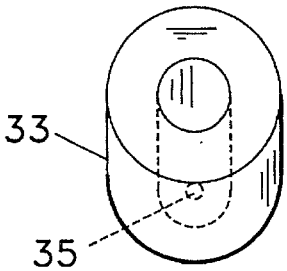
FIG. 14

DOOR ALARM/SPRAYER WITH OPTIONS

BACKGROUND OF THE INVENTION

The invention relates generally to a portable, reusable, anti-burglar booby trap device in some respects similar to patents issued to Fegley et al. in U.S. Pat. Nos. 4,024,986, 4,062,473 and 4,055,277 and more particularly to an anti-burglar booby trap device which discharges a chemical such as tear gas from a pressurized container into the protected area. This device differs in that it is combined with other important distinct and original features. The device has a unique battery operated audible alarm feature which may be optionally preset to operate when the device detects violation. This results in a variety of effects on the intruder. One effect is attraction of the intruder to view and/or attempt to disarm the alarm and expose himself or herself to greater exposure to any dispensed chemical or compound. Moreover, should the intruder touch the device a fingerprint retaining surface will preserve any fingerprints and thus may be useful in prosecution of the intruder.

The device in its preferred embodiment is designed to be portable for use such as in hotel rooms, mobile homes and offices and dwellings. Forced evacuation of the intruder is optional and can be influenced by varying the sound level of the audible alarm and depending on the type of gas or fluid or powder dispensed from the device. This option allows the user to vary the application to situations where trying to apprehend or photograph or video tape the intruder may be of greater value than forcing his/her immediate evacuation.

SUMMARY OF THE INVENTION

The principle object of the present invention is to provide a portable, reusable and variably applicable anti-burglar device having optional chemical dispensing capability as well as optional audible alarm and a finger print retaining surface features. The dispersing of spray and/or the audible alarm may be triggered directly by a relatively small amount of mechanical movement such as the removal of a retaining clip.

The device provides several features: one, for a retaining clip, engaged to a cocked spring biased plunger bar and attached by lanyard to a moveable body, such as a door, to release the spring biased plunger bar. The plunger bar is engaged to a slide bar which slides down some guide slots pulling the plunger bar with it, causing the plunger bar to depress a spray canister nozzle. Thus typical chemical dispensing mode is accomplished.

Another feature is an electrical circuit comprising a switch comprised of: a pair of contact points, one point located at the slide bar and the other contact point in an area below the slide bar so that when the retaining clip is removed the two contact points are brought together and the electric circuit is completed and maintained as the slide bar moves away from its cocked position, in the direction of the spring bias release position. This is hereafter referred to as the slide bar switch. Another part of the circuit is a two terminal toggle or slide switch, hereafter toggle switch, wired in series between the aforementioned slide bar switch and a battery; an interchangeable or adjustable buzzer or other battery powered alarm, hereafter buzzer, wired in series between the battery and said toggle switch; a dry cell battery holder; and a dry cell battery. Thus if no canister is in place and the retaining clip is removed thereby triggering the slide bar to move in the direction of the spring bias release position and if the toggle switch is thrown in the closed position the circuit will be completed between the battery and the buzzer through the toggle switch and the slide bar switch and assuming all of the above mentioned components are of relative compatible strength the buzzer will sound when the retaining clip is pulled. Thus the device can be operated in a mode of triggering only an audible alarm by simply omitting the placement of a charged chemical dispensing canister. Also, an electrical interface on the buzzer can be utilized to support other electrical devices that may be connected thereto.

Another feature of the device is that the canister retaining chamber is rotatably mounted within the main chamber housing to allow for directional adjustment of the canister spray nozzle allowing for adaptation to advantageously direct the spray discharge. However it is important to note that unlike the FEGLEY PATENTS the discharge is accomplished through vent holes in the housing and not through an accessible nozzle which might easily be thwarted by placing an empty can or a rag over the discharge nozzle or by insects which might nest in the orifice of final discharge. In other words the pressurized canister discharges through its own manufacturer supplied nozzle from within the housing and not through channeling of a stream of chemical through a dispensing spout that leads to the exterior of the housing.

Another feature of the device is that the chamber housing is tamper resistant by having a pair of latch brackets, which hold the chamber housing firmly attached to a chamber base from midway points on opposite sides of the base and chamber housing, the latch brackets are permanently and pivotally mounted to the base and by rotating them, the cover can either be removed for maintenance or secured against removal.

Another feature is that the chamber base is fitted with pivotally mounted mounting brackets which allow for a variety of mounting orientations.

BRIEF DESCRIPTION OF THE DRAWING

All figures referred to below represent the same version of the preferred embodiment.

FIG. 9A is an exploded oblique view of the tamper resistant right latch bracket.

FIG. 9B is an exploed oblique view of the tamper reistant left latch bracket.

FIG. 10 is an exploded oblique view of the top end cap.

FIG. 11 is an exploded oblique view of the pivot pin.

FIG. 12 is an exploded oblique view of the circlip.

FIG. 13 is an exploded oblique view of the spacer washer.

FIG. 14 is an exploded oblique view of the hemispherical bottom end cap.

DETAILED DESCRIPTION

Figure 1:
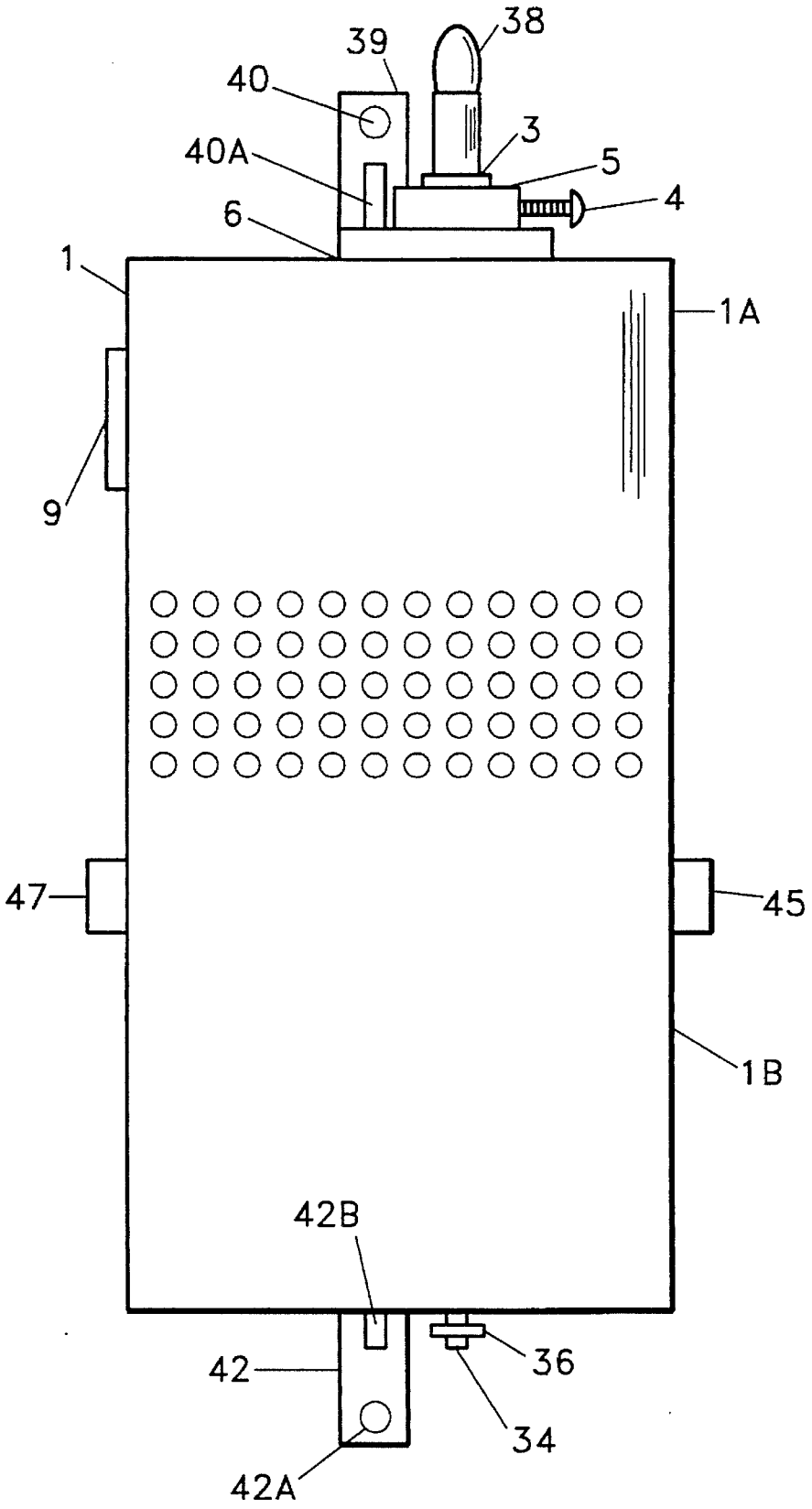
FIG. 1 is a front elevational view of the door guard device.
Figure 2:
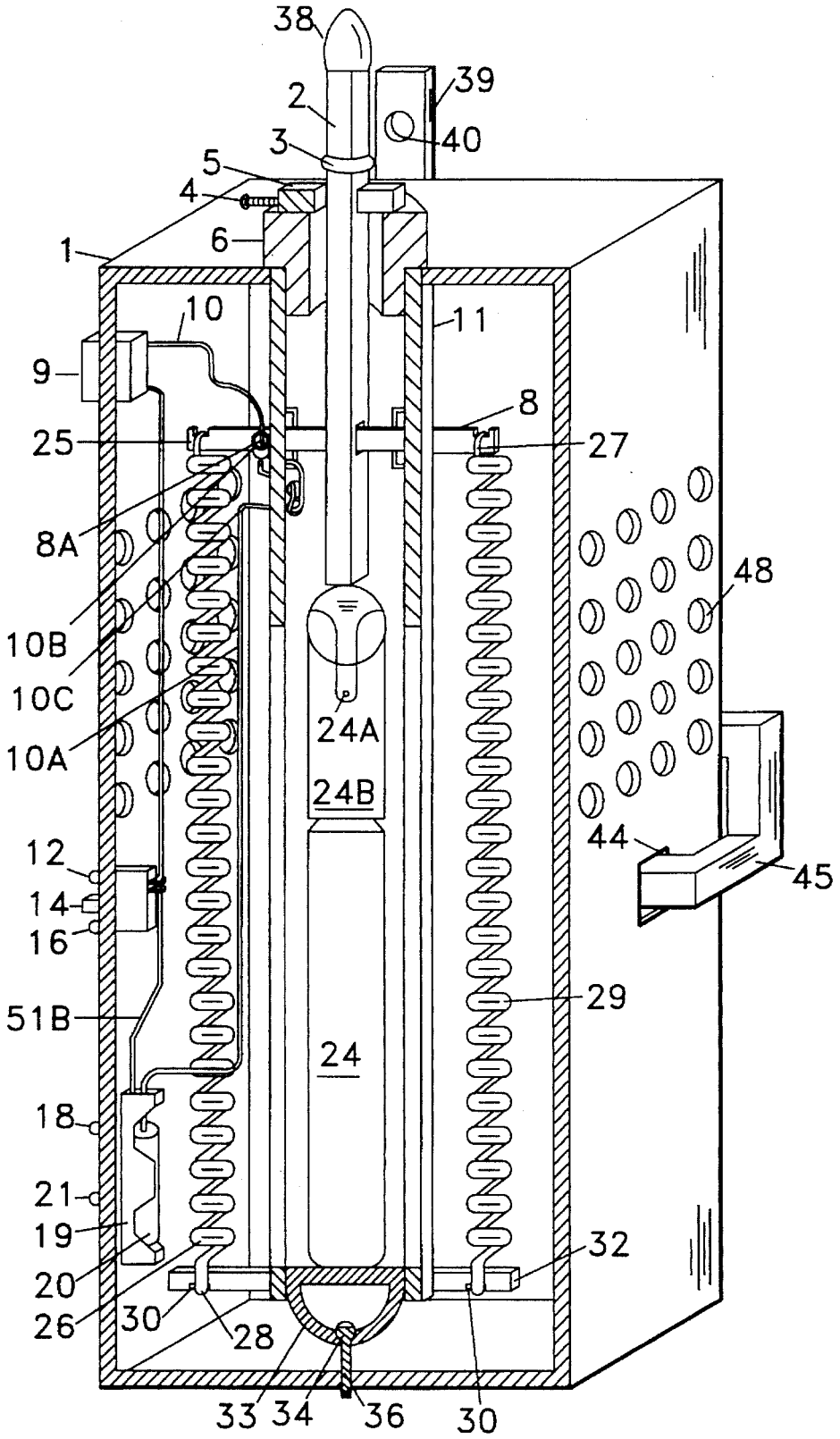
FIG. 2 is a vertical oblique sectional view of the door guard device with the front surface removed.
Figure 3:
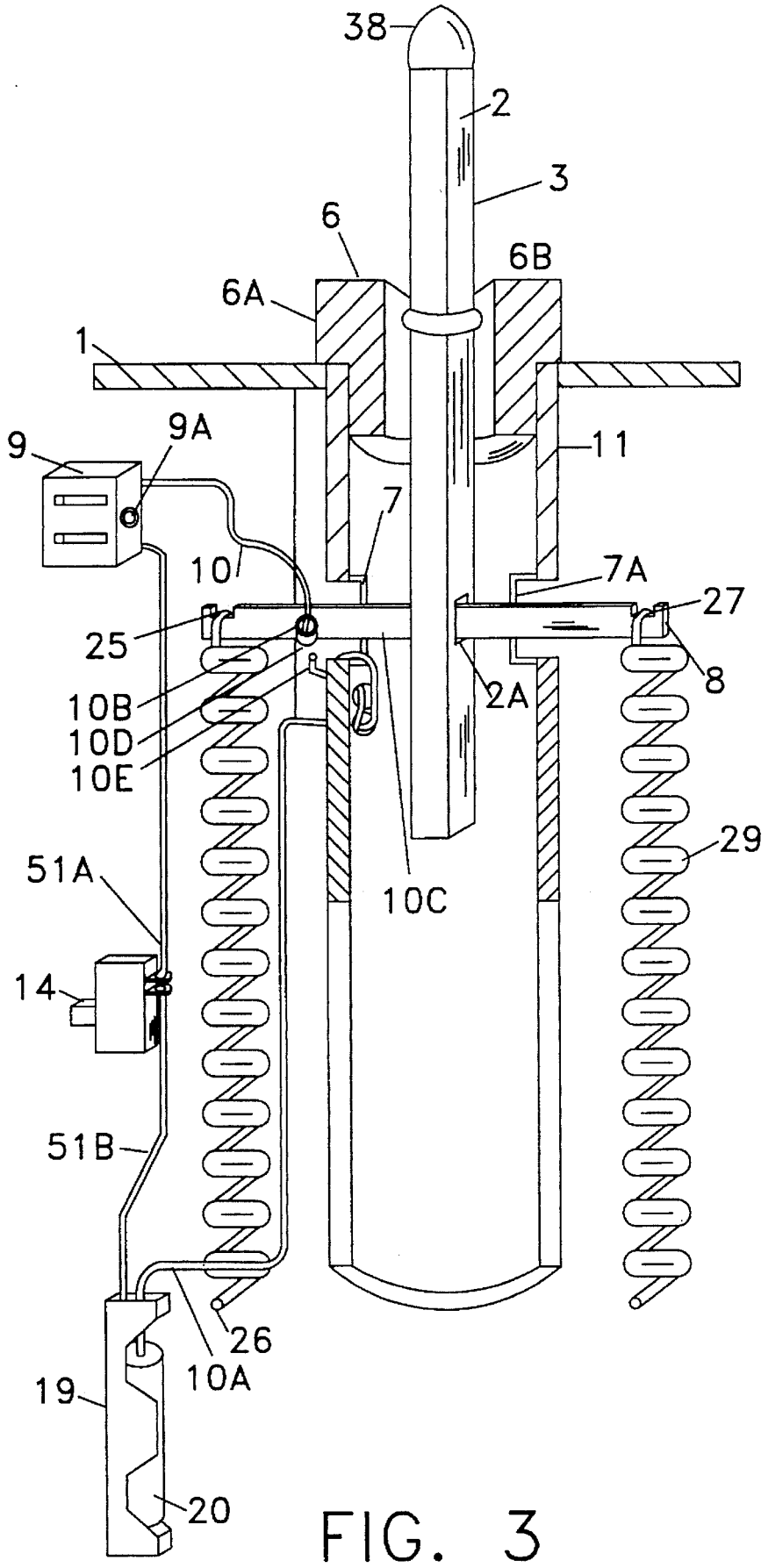
FIG. 3 is a partial vertical section showing a preferred embodiment of the electrical components and the plunger bar and slide bar and slide bar switch.
Figure 4:
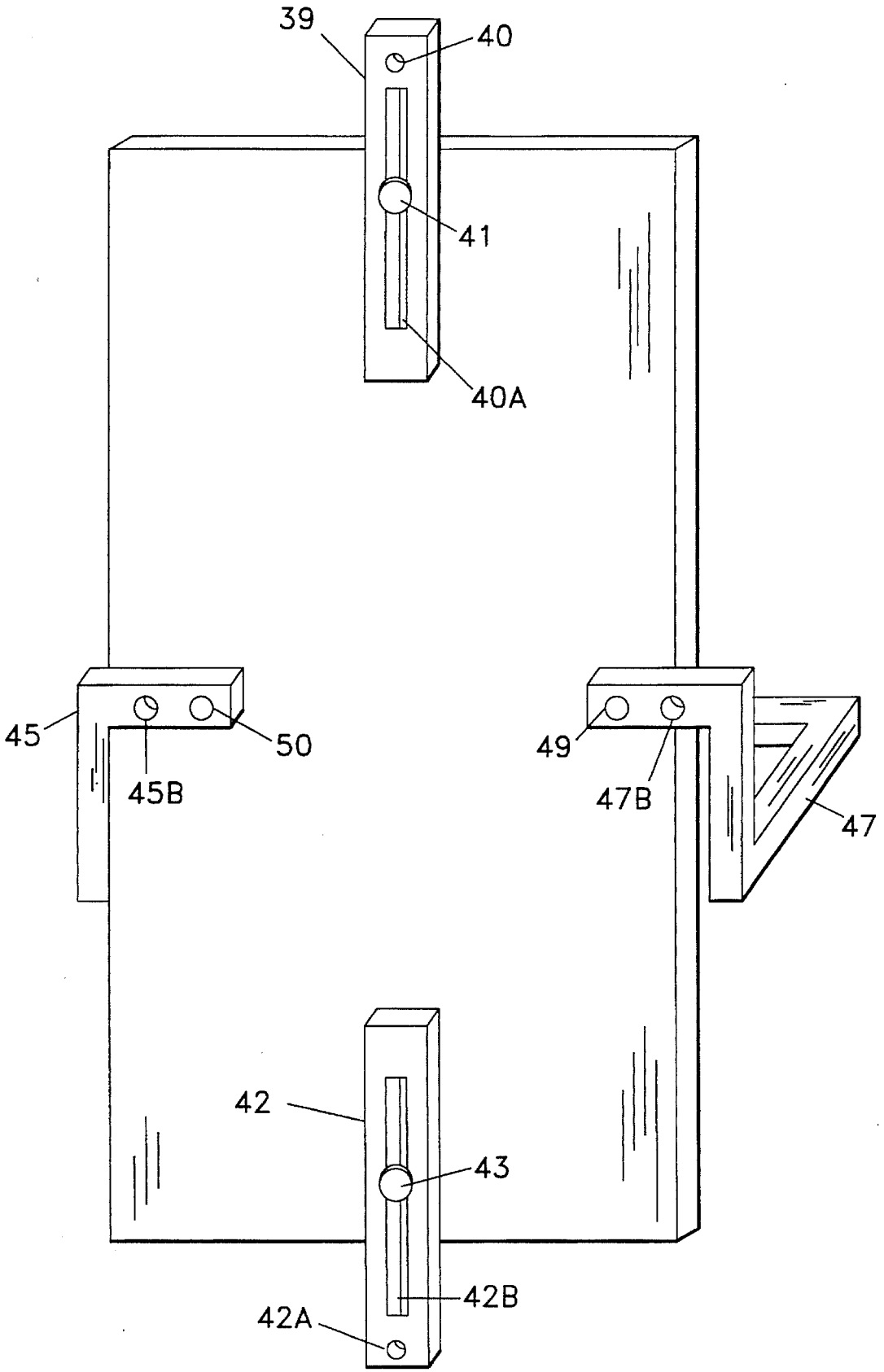
FIG. 4 is a rear view of the chamber base showing the mounting brackets and the tamper resistant latch brackets.
Figure 5:
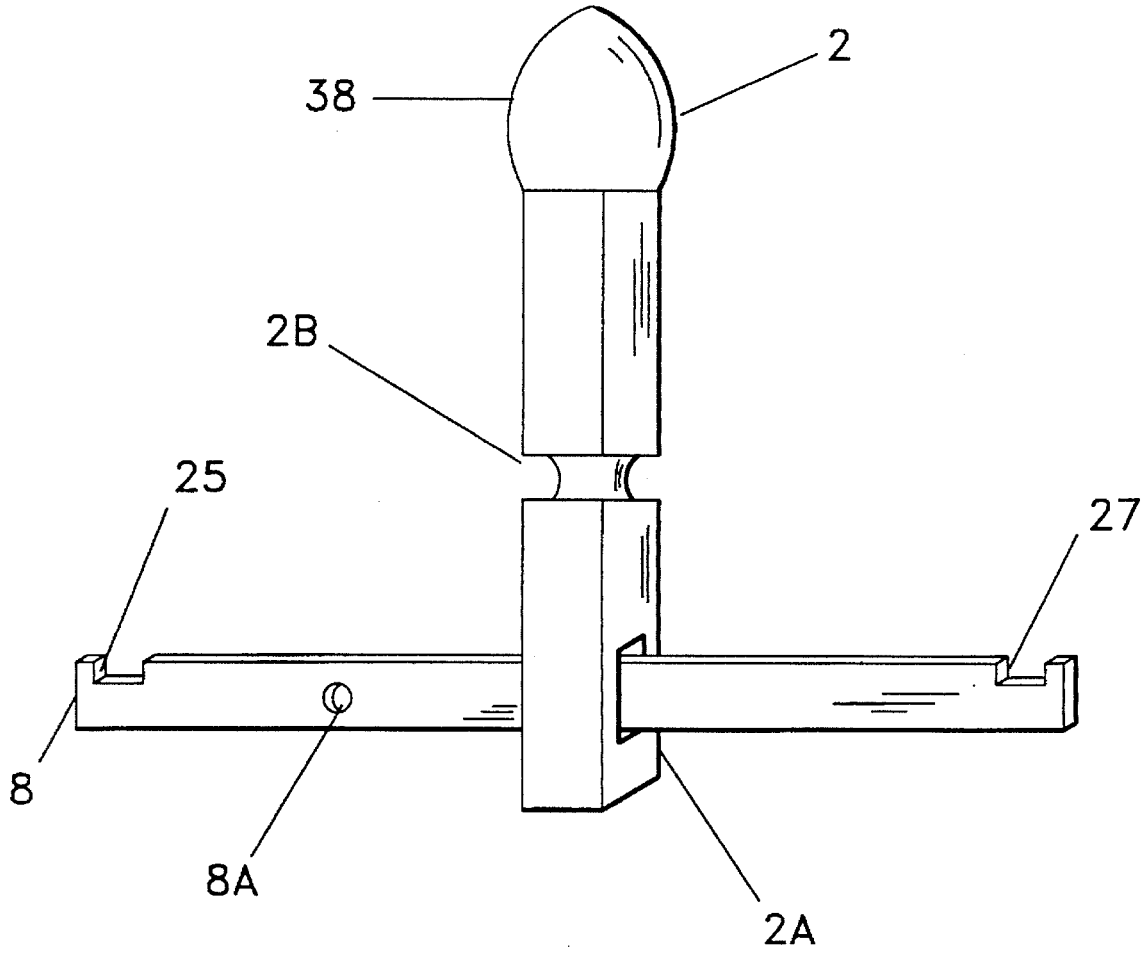
FIG. 5 is a view of the plunger bar and the slide bar shown in engagement, and the plunger bar retaining bead.
Figure 6:
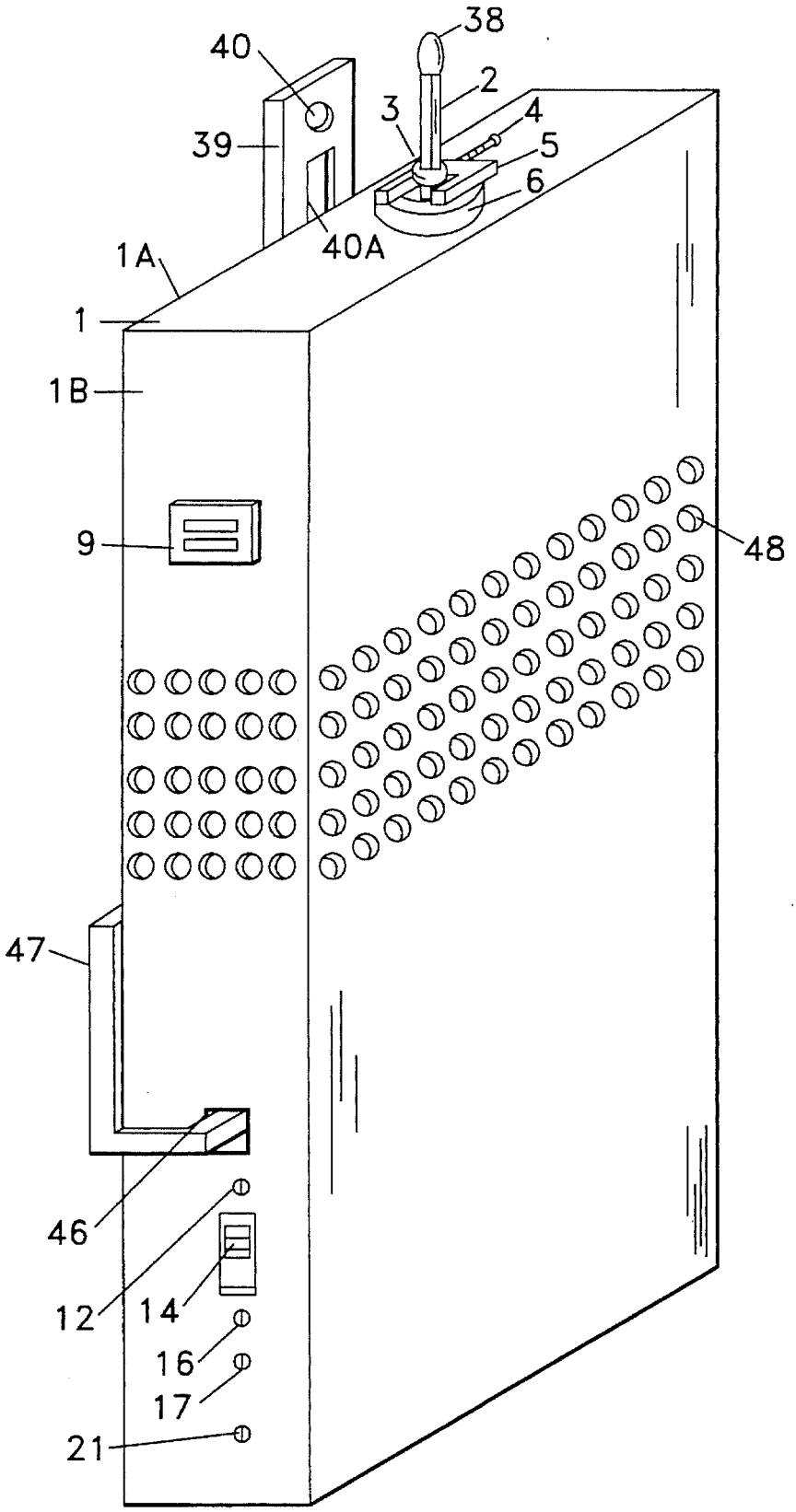
FIG. 6 is an oblique left side view of the door alarm.
Figure 7:
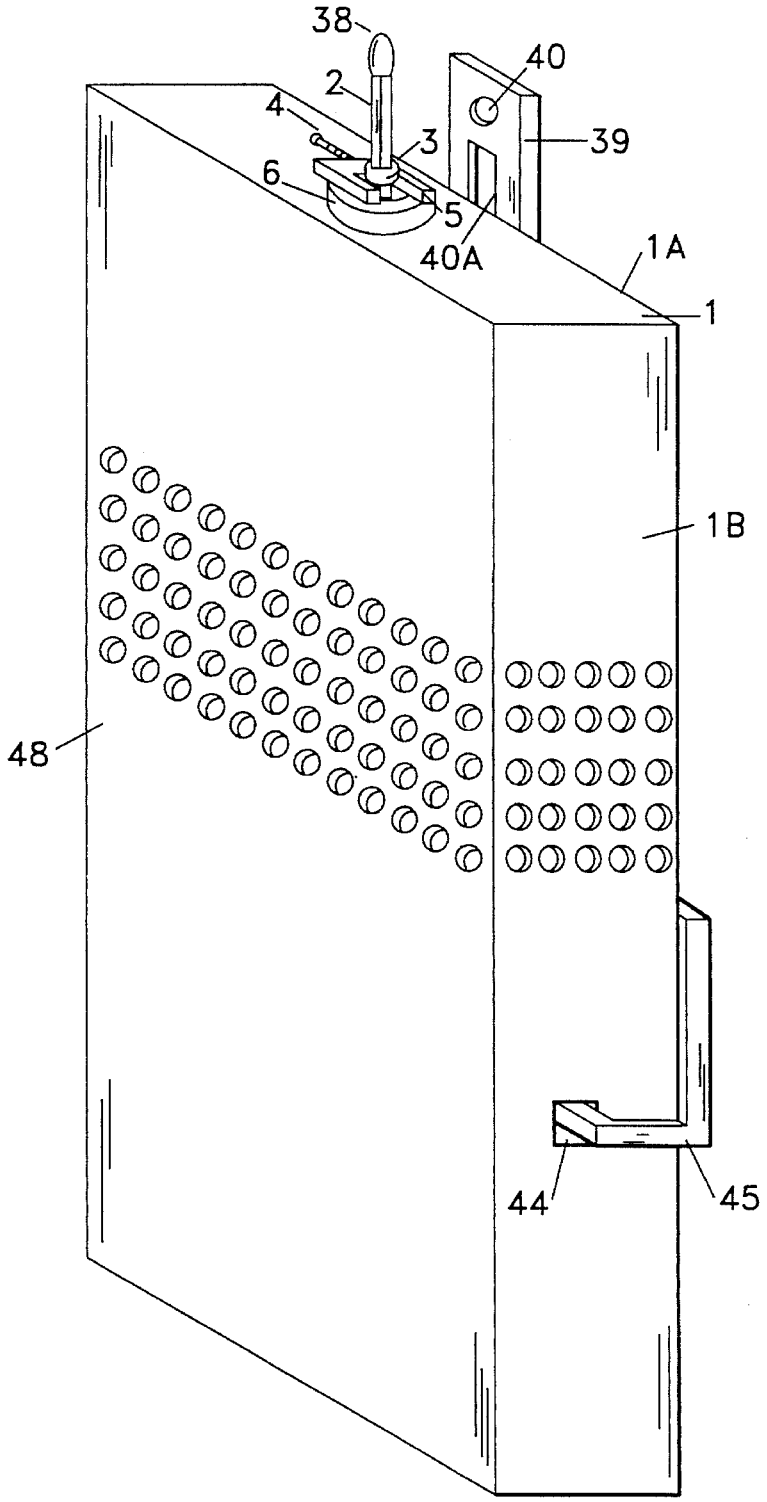
FIG. 7 is an oblique right side view of the door alarm.
Figure 8:
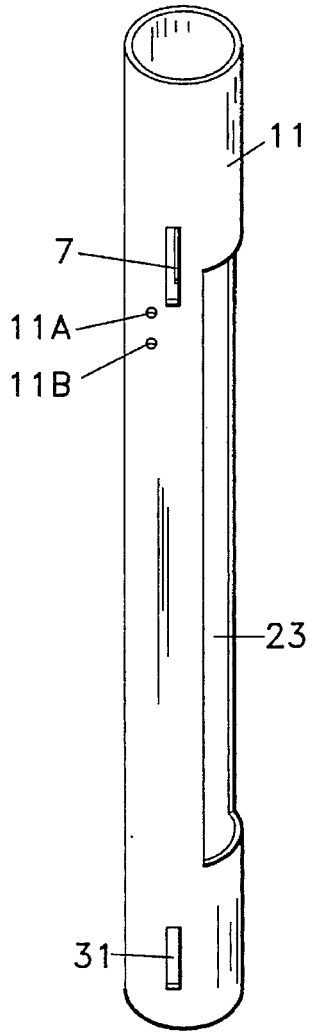
FIG. 8 is an exploded oblique view of the canister chamber components.

Referring to the drawing in detail, wherein like reference characters designate like parts throughout the various views, there is shown in FIGS. 1 through 14, one form of the door alarm/sprayer with options called device hereafter. The device shown in FIG. 1, generally the size and shape of a typical household butter dish and cover, is a portable reusable anti-burglar device with optional, fluid dispensing capability, an alarm and fingerprint retention features. The device is mounted by mounting bracket 39, as shown in FIGS. 1, 2 and 4, and mounting bracket 42, as shown in FIGS. 1 and 4. The mounting hole 40, as shown in FIGS. 1 and 4, and the mounting hole 42*a*, as shown in FIGS. 1 and 4 are used for securing said device to a surface by resistant means. As the mounting brackets are pivotally mounted they can be adapted to a variety of mounting situations. The latch bracket 47, as shown in FIGS. 2 and 4, is attached to chamber base 37, as shown in FIG. 4, by a rivet 49, as shown in FIG. 4, is rotated into slot 44, as shown in FIGS. 2 and 7, and the latch bracket 45, as shown in FIGS. 1, 4 and 6, is attached to said chamber base 37, as shown in FIG. 4, by a rivet 50, as shown in FIGS. 2 and 4, is rotated into the slot 46, as shown in FIG. 6, to attach the canister housing to the chamber base. The device also has a tar or wax coating 1*b* as shown in FIG. 6, which is intended to be on the surface 1, as shown in FIGS. 1, 2, 6 and 7, of the device. The device is tripped by the opening of a door or window or some other violation of a secured lanyard attached on one end to a secure surface and on the other end to a retaining clip 5, as shown in FIGS. 1, 2, 6 and 7, which keeps a plunger bar 2, as shown in FIGS. 2, 3, 5 and 6, cocked on the device. Said retaining clip is fitted with a screw or other means for attaching a lanyard. When said lanyard pulls said retaining clip out of engagement with the plunger bar, a spring biased slide bar 8, as shown in FIGS. 2, 3 and 5, slides down guide slots 7, 7*a*, as shown in FIGS. 3 and 8, and operates to pull on said plunger, causing said plunger to depress a nozzle on a spray canister and discharge a pre-packaged tear gas or identification fluid or other fluid as may be in such a dispensing canister 24, as shown in FIG. 2. This same actuation also simultaneously closes an electrical switch which comprises of electrode contacts 10*b* and 10*c* of FIGS. 2 and 3. This switch called, the slide bar switch, is wired in series with a toggle or slide switch 14, as shown in FIGS. 2 and 3, which controls the optional operation of having an audible alarm 9, as shown FIGS. 2 and 3, sound when the device is activated. This is accomplished if the toggle switch is thrown in the closed position because the circuit will be completed between the battery and the buzzer through the toggle switch and the slide bar switch and assuming all of the above mentioned components are of relative compatible strength the buzzer will sound when the retaining clip is pulled. The device can be operated in a mode of triggering only an audible alarm by simply omitting the placement of a charged chemical dispensing canister. Also, a terminal for an electrical interface 9*a*, as shown in FIG. 3, on the buzzer can be utilized to support other electrical devices that may be connected to the terminal via electronic interfacing means to said buzzer activating electrical circuit.

By throwing the toggle switch in the open position the alarm will not sound when the device is tripped. The buzzer 9, as shown in FIGS. 2 and 3, has two current paths whereby it may be wired in series with a battery. The device exterior is coated 1*b*, as shown in FIGS. 1, 2, 6, and 7, with a wax or tar material which is capable of preserving fingerprints that may be deposited on the device by a surprised intruder, in an attempt to deactivate it. A cylindrical canister chamber assembly 23, comprised as shown in FIG. 8 of a body tube and other components, is pivotally mounted between two holes in opposite, top and bottom, ends of the chamber housing 1, as shown in FIG. 2. Said canister assembly and top and bottom canister housing holes are in concentric alignment. Said canister chamber's vertical space is adjusted by the insertion or removal of spacers 53, as shown in FIG. 8. Said assembly is held in place by a pivot pin 34, as shown in FIGS. 2 and 11, which is inserted through said canister assembly hemispherical bottom end cap 33, as shown in FIGS. 2 and 14, which is fixed to the bottom of the body tube 11, as shown in FIGS. 2, 3, and 8, and pivotably though snugly through said canister chamber housing 1, as shown in FIGS. 1, 2, 6, and 7, bottom. Said pivot pin has a pan head top and circlip receiving bottom ends and is fitted with a circlip 36, as shown in FIGS. 1, 2 and 12, on the bottom end to prevent vertical movement of said canister chamber 23, as shown in FIGS. 2 and 8, once the circlip 36, as shown in FIGS. 1, 2 and 12, is in place. A top end cap 6, as shown in FIGS. 1, 2, 3, 6, 7, and 10, holds the top of the body tube 11, as shown in FIGS. 2 and 8, in pivotal engagement with said canister chamber housing 1, as shown in FIGS. 1, 2, 6 and 7, top by being snugly fit or otherwise attached to the body tube. Said top end cap also has a flange 6*a*, as shown in FIG. 3, which acts as a shoulder for shouldering said retaining clip when said retaining clip 5, as shown in FIGS. 1, 2, 6, and 7, is engaged to said plunger bar 2, as shown in FIGS. 2, 3, 5, 6 and 7, and also provides a connecting body 6C, as shown in FIG. 3 for connecting said body tube upper end thereto. Said top end cap 6, as shown in FIGS. 1, 2, 3, 6, 7 and 10, has a hole 6*b*, as shown in FIG. 3, bored through its longitudinal centerline which allows free longitudinal movement of said plunger bar. The body tube 11, as shown in FIGS. 2 and 8, has slotted holes 7 and 7*a*, as shown in FIG. 3, located near the top end of said body tube so as to be located above a typical pressurized canister's manufacturer's nozzle 24, as shown in FIG. 2, when in place in the canister chamber 23, as shown in FIG. 8, and, oriented along said slot's major dimension, parallel to said body tube's longitudinal axis. Said slotted holes' 7 and 7*a*, as shown in FIGS. 3 and 8, alignment transverses the centerline of the canister chamber 23, as shown in FIG. 8, through both walls of the canister chamber thus traversing the centerline of said canister chamber. The holes' major dimension is about ¼ inch to 1 inch long and its minor dimension is about 1/16 inch to 3/16 inch wide. A slide bar 8, as shown in FIGS. 2 and 3, is located through said slotted holes and said plunger bar as shown in FIGS. 1, 2, 3 and 5, with notches 25 and 27, as shown in FIG. 2, facing upwards. An identical bar is fixed near the bottom of said chamber 23, FIG. 2, hereafter referred to as fixed bar 32, as shown in FIGS. 2 and 3, in parallel alignment with said slide bar 8, as shown in FIGS. 2 and 3, but placed with notches 28 and 30, as shown in FIG. 2, facing downwards. Thus both bars have notched ends for receiving biasing springs 26 and 29, as shown in FIG. 2, which are connected so as to pull said slide bar 8, as shown in FIGS. 2 and 3, towards said fixed bar 32, as shown in FIGS. 2 and 3 through the limits of the range of movement allowed by said slotted holes. Thus the canister chamber 23, as shown in FIG. 8, is mounted to said canister chamber housing 1, as shown in FIGS. 1, 2, and 6, ready to be tripped.

When said plunger bar 2, as shown in FIGS. 2, 3, 5, 6 and 7, is pulled away from said canister chamber housing 1, as shown in FIGS. 1, 2, 6 and 7, by means of pulling on the knob 38, as shown in FIG. 2, the springs 26 and 29, as shown in FIGS. 2 and 3, fight to pull said plunger 2, as shown in FIGS. 2, 3, 5, 6, and 7, back. At a point where said plunger bar is fully pulled out, a semi-circular retaining clip 5, as shown in FIGS. 1, 2, 6 and 7, hereafter retaining clip, is placed under a retaining bead 3, as shown in FIGS. 1, 2 and 3, or in another embodiment, into a circumferential slot, 2*b* as shown in FIG. 5, in the plunger bar 2, as shown in FIGS. 2, 3, 5, 6, and 7, which is exposed at full extraction and which is designed to accept said retaining clip 5, as shown in FIGS. 1, 2, 6 and 7. Once the retaining clip 5, as shown in FIGS. 1, 2, 6, and 7, is in place, the plunger bar 2, as shown in FIGS. 2, 3, 6 and 7, is released and the plunger bar is maintained in a cocked position when said retaining clip 5, as shown in FIGS. 1, 2, 6, and 7, now under said bead on said plunger bar 2, as shown in FIGS. 2, 3, 6 and 7, comes in contact with said top end cap flange 6*a*, as shown in FIG. 3, and is held pinched there by the tension of said biasing springs 26 and 29, as shown in FIGS. 2 and 3 acting on said plunger bar through said slide bar. Said biasing springs 26 and 29, as shown in FIGS. 2 and 3, are of a strength which will allow the retaining clip 5, as shown in FIGS. 1, 2, 6, and 7, to be easily removed yet still be able to depress a pressurized canister button 24*b*, as shown in FIG. 2. The slide bar 8, as shown in FIGS. 2 and 3, is fitted with one end of an electricity conducting insulated wire 10, as shown in FIG. 3, hereafter buzzer wire, by fixing by means of screw 10B, as shown in FIG. 3,and eyelet or snap fitting, or soldering. A dry cell battery holder 19, as shown in FIGS. 2 and 3, having a positive wire 51B, as shown in FIGS. 2 and 3, and a negative wire 10A, as shown in FIGS. 2 and 3, is attached by rivets or tamper resistant screws or glue to an inner wall of the canister chamber housing 1, as shown in FIGS. 1, 2, 6 and 7. The body tube is fitted with the negative wire 10A, as shown in FIG. 3, from the battery holder 19, as shown in FIG. 3, hereafter negative wire, by lacing said negative wire 10A, as shown in FIGS. 2 and 3, through two or more holes 11*a* and 11*b*, as shown in FIG. 8, located near the bottom end of said slotted hole 7, as shown in FIG. 8, and being located on the same side of said chamber nearest the side where the buzzer wire 10, as shown in FIGS. 2 and 3, is fitted to the slide bar 8, as shown in FIGS. 2 and 3, and being shaped in spring like fashion 10*d*, as shown in FIG. 3, so as to come in contact with said buzzer wire 10, as shown in FIGS. 2 and 3, almost immediately and continually once said plunger bar 2, as shown in FIGS. 2, 3, 4, 5, 6 and 7, are released. In another embodiment said holes 11A and 11B, as shown in FIG. 8, for lacing said wire through are replaced with a metallic leaf spring 10E as shown in FIG. 3, and attaching eyelet and screw. Thus the buzzer 9, as shown in FIGS. 2 and 3, is connected to said battery holder wire 51A, as shown in FIG. 3, on one of two electricity current paths. A slide or a toggle switch 14A as shown in FIG. 3, or other switch 14, as shown in FIGS. 2 and 3, having two poles or connecting terminals for series wiring and on or off positions is also fitted to the inside, or outside, of said canister chamber housing 1, as shown in FIGS. 1, 2, 6 and 7. One pole is connected by wire 51A, as shown in FIG. 3, or other like means to the battery holder 19, as shown in FIG. 3, positive side and the other pole is connected to the other of the two current paths of the buzzer 9, as shown in FIGS. 2 and 3, which is not already connected to the slide bar 8, as shown in FIGS. 2 and 3. Thus when the battery 20, as shown in FIG. 2, is in place and the toggle switch 14*a*, as shown in FIG. 3, is thrown in the on or closed position the buzzer 9, as shown in FIGS. 2 and 3, will be in operational circuit with the battery 20, as shown in FIG. 3, once the device is tripped. When said toggle switch 14A, as shown in FIG. 3, is set in the off position, only the plunger 2, as shown in FIGS. 2, 3, 4, 5, 6 and 7, will operate to depress the nozzle 24*a*, as shown in FIG. 2, of a canister 24, as shown in FIG. 2, secured in said canister chamber 23, as shown in FIG. 8.

I claim:

1. A door alarm/sprayer device comprising:

(a) a chamber base having front and back sides and top and bottom ends and two vertical edges and pivotally mounted mounting brackets mounted to the back side of said chamber base which allow for a variety of mounting orientations and at least two pivotally mounted latch brackets mounted midway along each of said chamber base vertical edges;

(b) A chamber housing, having longitudinal and latitudinal axes and having inner and outer walls on each of five sides comprising top and bottom sides, and front and left and right sides as viewed from the front side, wherein said chamber base and and said chamber housing fit snugly together and said chamber housing further has a latch bracket receiving hole in the left and right sides and a dry cell battery holder having two terminal wires for connecting a battery that may be mounted therein with other electrical components of said device, said holder being mounted to an interior wall of said chamber housing;

(c) A canister chamber assembly comprising a canister chamber which further comprises a cylindrical hollow tube hereafter body tube having an open top end and a hemispherical capped bottom end and an assortment of spacers for adjusting the hollow space within said cylindrical hollow tube, further having a longitudinal section removed from said cylindrical hollow tube whereby there is permitted the housing, insertion and removal of a variety of pressurized chemical dispensing canisters that have a pressurized canister's manufacturer's nozzle, within said hollow tube, slotted holes, located near the top end of said tube so as to be located above pressurized canister's manufacturer's nozzle when in place in the canister chamber, said holes' alignment transverses the centerline of the body tube at a right angle, through the walls of the body tube chamber 180 degrees apart and are latitudinally centered, said holes major dimension is about ¼ inch to 1 inch long and their minor dimension is about 1/16 inch to 3/16 inch wide and a parallel hole located near the bottom end of said body tube whereby a spring biasing fixed bar may be mounted, a pivot pin whereby said hemispherical capped bottom end is snugly but rotatably connected to said chamber housing bottom side;

(d) A slide bar comprising a flat elongated bar having a rectangular cross section and having two ends and having one notch near each of said ends for receiving a spring loop therein and being long enough to protrude through said body tube slotted holes yet able to slide within said slotted holes and being centered and in firm engagement with a plunger bar and having an electrode mounting hole through said slide bar located at a point between the outside of said canister chamber and one of said notches;

(e) A fixed spring biasing bar, hereafter fixed bar, mounted with notches facing opposite of said slide bar notches near the bottom end of said body tube being identical to said slide bar but without said electrode mounting hole;

(f) a slide bar switch comprising of two electrodes, one electrode comprising a current conducting wire fixed to said slide bar electrode mounting hole and another like electrode being mounted to said canister chamber adjacent to one of said canister chamber slotted holes whereby when said device is tripped and said plunger bar is retracted said two electrodes are brought into contact with each other, closing the switch;

(g) An alarm comprising a buzzer small enough to be housed within said chamber housing along with all other components;

(h) Two coil springs each having top and bottom loops for connecting said springs to said fixed bar by looping said bottom loops one through each of said fixed bar notches and further connecting said springs' top loops one through each of said slide bar notches, said springs are parallel to each other and to said canister chamber's longitudinal axis whereby said springs operate to pull said slide bar towards said fixed bar and thereby operate to further pull said plunger bar to depress a pressurized canister nozzle and cause its actuation and further actuate said slide bar switch;

(i) an electrical switch such as a slide or toggle switch hereafter toggle switch having at least two poles for connecting said switch in on/off operational ability being wired in series between said slide bar switch and said battery said toggle switch being mounted to one of said canister chamber housing sides inner walls;

(j) Said buzzer further having first and second electrical connections capable of emitting an audible sound when connected to a buzzer activating electrical circuit comprising a battery housed in the battery holder said buzzer being wired in series from said first connection to said toggle switch and from the second connection to said slide bar whereby when said device is tripped and said toggle switch is in the on position said buzzer will sound;

(k) a top end cap having, a flange on one end and a hole through said top end cap concentrically centered in said cap whereby said plunger rod may freely but snugly be allowed to move in a motion parallel to said longitudinal axes therein, said cap fits snugly into said body tube being inserted therein through a hole in said top side of said canister housing and its flange abuts said canister chamber's top side;

(l) Said plunger bar further having a knobed top end and a bottom end further comprising a slide bar receiving hole transversely through said bar located between said bottom end and a point midway between said top and bottom end nearer said bottom end whereby said slide bar may be loosely but snugly fit in said slot, said plunger bar further comprising a retaining clip and a circumferential bead located between said plunger bar knob and a point midway between said knobbed top end and said slide bar receiving hole for shouldering said retaining clip thereby allowing said plunger bar to be used as an aiming mechanism for presetting the general direction in which said spray canister is discharged and further allowing said retaining clip to be removed from said bead from any preset radial direction without interfering with said aim;

(m) a wax or tar coating around the exterior of said chamber housing which is capable of preserving fingerprints;

(n) A plurality of holes or slots drilled or punched or molded in said canister housing on the front and left and right sides of said canister housing being about from 1/16 inch to 1/4 inch in diameter located in an area comprising a band in a latitudinal plane on said canister housing at a point whereby a manufacturers chemical dispensing canister and nozzle could project it's discharge spray through said holes;

(o) said two latch brackets mounted to the back side of said chamber base comprising formed rods each having a canister housing engagement end, a midway point and a chamber base mounting end and each further having a pair of holes located proximately parallel and adjacent to each other and being located midway between said brackets' canister housing engagement ends and said chamber base mounting ends whereby when a screw or rivet is used to connect one of said brackets to said chamber base back side aproximately midway along said vertical edge thereof by either of said holes, the brackets are held pivotally attached to said chamber base; said latch brackets are permanently and pivotally mounted to the base and when rotated can engage the chamber housing firmly by being rotated to insert said canister housing engagement ends into said chamber housing latch bracket receiving holes and by said pivotal mounting the cover can either be removed for maintenance or secured against removal and by placing a screw in said adjacent hole said latch brackets are fixed against pivotal movement.

2. The same device as in claim 1 wherein said slide or toggle switch is mounted to be operable from the exterior of said device.

3. The same device as in claim 1, where said shouldering means for shouldering said retaining clip comprises a circumferential notch cut into said plunger rod.

4. The same device as in claim 3 wherein the device is fitted with a terminal for connecting electronic interfacing means such as a compatable mating terminal, to said buzzer activating electrical circuit.

5. The same device as in claim 3 wherein said buzzer is adjustable and replaceable.

6. The same device as in claims 1, 2, 3 or 4 where said device has a finger print retaining surface.

* * * * *